US009662774B2

(12) United States Patent
Whitehead

(10) Patent No.: US 9,662,774 B2
(45) Date of Patent: May 30, 2017

(54) UNIVERSAL HOLDING WRENCH

(71) Applicant: Lisle Corporation, Clarinda, IA (US)

(72) Inventor: Michael L. Whitehead, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 338 days.

(21) Appl. No.: 14/632,705

(22) Filed: Feb. 26, 2015

(65) Prior Publication Data

US 2015/0343620 A1 Dec. 3, 2015

Related U.S. Application Data

(60) Provisional application No. 62/006,596, filed on Jun. 2, 2014.

(51) Int. Cl.
*B25B 23/00* (2006.01)
*B25B 23/10* (2006.01)

(52) U.S. Cl.
CPC ..... *B25B 23/0085* (2013.01)

(58) Field of Classification Search
CPC ..... B25B 23/0085; B25B 23/10; B25B 9/00; B25B 13/02; B25B 13/48; B25B 13/481
See application file for complete search history.

(56) References Cited

U.S. PATENT DOCUMENTS 6,343,529 B1 2/2002 Pool
6,640,670 B2 * 11/2003 Belcher ..... B25B 27/0035 81/13
6,912,936 B2 * 7/2005 Hume ..... B25B 13/48 81/119
7,024,745 B1 * 4/2006 Mayer ..... B25B 9/00 29/402.03
9,073,185 B2 * 7/2015 Oachs ..... B25B 13/481 29/888.025

OTHER PUBLICATIONS

Jason W. Cynova, "Fan Clutch Removal Tool for 6.9L + 7.3L Fords", Invention Disclosure Agreement, Aug. 26, 1997, Lisle Corporation, Clarinda, Iowa, United States of America.
Hugo Alberto Barahona, "Fan Clutch Holding Wrench", Idea Disclosure Agreement, Mar. 7, 2000, Lisle Corporation, Clarinda, Iowa, United States of America.
Roger Kryling, "Fan Removal Tool", Idea Disclosure Agreement, Oct. 3, 2000, Lisle Corporation, Clarinda, Iowa, United States of America.
Kenneth D. Myers, "Dodge/Chrystler 3.9L V-6 Fan Clutch Holding Tool", Idea Disclosure Agreement, Aug. 14, 2002, Lisle Corporation, Clarinda, Iowa, United States of America.

(Continued)

*Primary Examiner* — David B Thomas
(74) *Attorney, Agent, or Firm* — Banner & Witcoff, Ltd.

(57) ABSTRACT

A unitary, or single, uniformly thick planar plate is configured whereby the plate may be utilized as a lever of the first kind to engage multiple arrays of fastening bolts. The plate includes a lever arm aligned with a longitudinal axis, a fastener engaging circular opening at one corner of the plate spaced laterally from the axis and at the end opposite outer end of the lever arm and a fastener engaging straight edge normal to the axis and tangent to the circular opening in the plate.

6 Claims, 3 Drawing Sheets

(56) References Cited

OTHER PUBLICATIONS

Francis J. Marconi, "TYROD Tool", "Torsion Bar Tool", "Vaevme Tool", and "Fan Remover Tool", Idea Disclosure Agreement, Mar. 10, 2005, Lisle Corporation, Clarinda, Iowa, United States of America.

Leroy Uhrig, "6.0L Fan Clutch R & R Tools Ford/Navistar Diesel", Idea Disclosure Agreement, Aug. 30, 2005, Lisle Corporation, Clarinda, Iowa, United States of America.

Charles Sawyer, "Removing Fan and Clutch from Water Pump", Idea Disclosure Agreement, Mar. 27, 2008, Lisle Corporation, Clarinda, Iowa, United States of America.

Steven C. McClurg, "Pulley to Remove Clutch Fan and Pulley to Loosen the Bolts from the Water Pump", Idea Disclosure Agreement, Jan. 15, 2013, Lisle Corporation, Clarinda, Iowa, United States of America.

Robert Bolmarcich, Richard Bolmarcich, "Water Pump Pulley Removal Replacement Tool", Idea Disclosure Agreement, Aug. 5, 2013, Lisle Corporation, Clarinda, Iowa, United States of America.

"Universal Fan Clutch Wrench Set", http://www.lislecorp.com/divisions/products/?product=571, retrieved from Internet Apr. 24, 2014, published date unknown, but prior to the filed of the present application, Lisle Corporation, Clarinda, Iowa, United States of America.

"Fan Clutch Wrench Set for Ford", http://www.lislecorp.com/divisions/products/?product=244, retrieved from internet Apr. 24, 2014, published date unknown, but prior to the filed of the present application, Lisle Corporation, Clarinda, Iowa, United States of America.

"Universal Fan Clutch Wrench Set", http://www.lislecorp.com/divisions/products/?product=257, retrieved from internet Apr. 24, 2014, published date unknown, but prior to the filing date of the present application, Lisle Corporation, Clarinda, Iowa, United States of America.

* cited by examiner

UNIVERSAL HOLDING WRENCH

CROSS REFERENCE TO RELATED APPLICATION

This is a utility application incorporating by reference and claiming priority to provisional application Ser. No. 62/006,596 filed Jun. 2, 2014 entitled "Universal Holding Wrench".

BACKGROUND OF THE INVENTION

In a principal aspect the present invention relates to a wrench construction which may be utilized to facilitate automotive and other types of repairs. By way of example, the wrench can be utilized to effect removal of a fan clutch from various models of vehicles as described in U.S. Pat. No. 6,343,529 entitled "Fan Clutch Wrench Kit" incorporated herewith by reference. The described kit in U.S. Pat. No. 6,343,529 includes two wrench constructions; namely, a holding wrench 21 designed to engage the fasteners associated with a fan clutch assembly and a turning wrench 23 which is used in combination with the holding wrench 21 to facilitate removal of the fasteners. While such wrench constructions are effective and useful, improvements thereto assist mechanics in their practice, the subject matter of the present invention comprises a wrench device which may be substituted for and utilized in place of the holding wrench 21 of U.S. Pat. No. 6,343,529.

SUMMARY OF THE INVENTION

Briefly, the present invention comprises a unitary, or single, uniformly thick planar plate configured in a manner whereby the plate may be utilized as a lever of the first kind in situations involving multiple arrays of fastening bolts or fasteners. Specifically, the plate includes a lever arm aligned with a longitudinal axis, a fastener engaging circular opening at one corner of the plate spaced laterally from the axis and a fastener engaging straight edge normal to the axis and tangent to the circular opening in the plate. With the design and construction of the wrench, it is possible to utilize a single wrench without mechanical adjustment thereof for gripping multiple patterns of or an array of bolts that must be engaged to facilitate and hold a mechanical device such as pulley bolted on a shaft in order to turn or manipulate other elements associated with the clutch by a second turning wrench.

These and other objects, advantages and features of the invention will be set forth in the detailed description which follows.

BRIEF DESCRIPTION OF THE DRAWING

In the detailed description which follows reference will be made to the drawing comprised of the following figures.

DETAILED DESCRIPTION OF AN EMBODIMENT OF THE INVENTION

Figure 1:
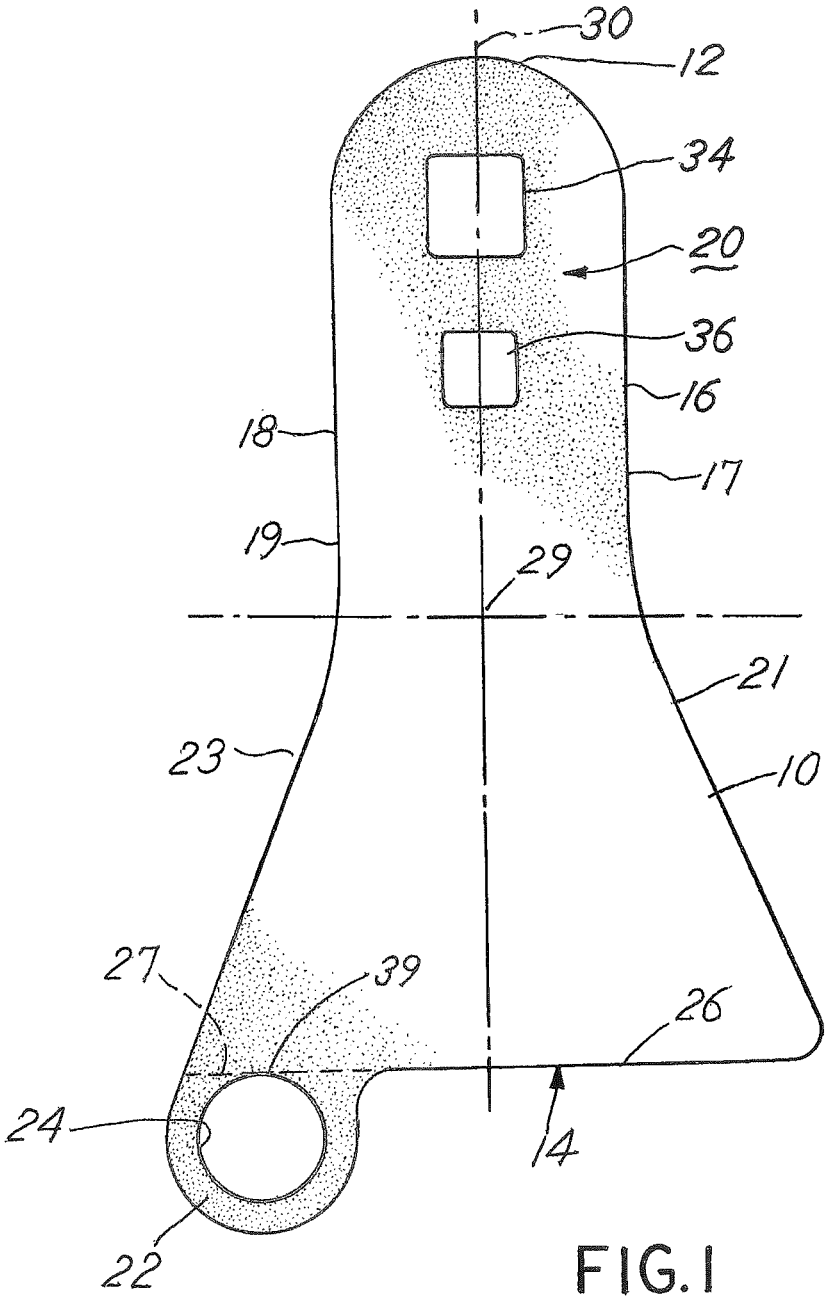
FIG. 1 is a plan view of the wrench of the invention.
Figure 2:
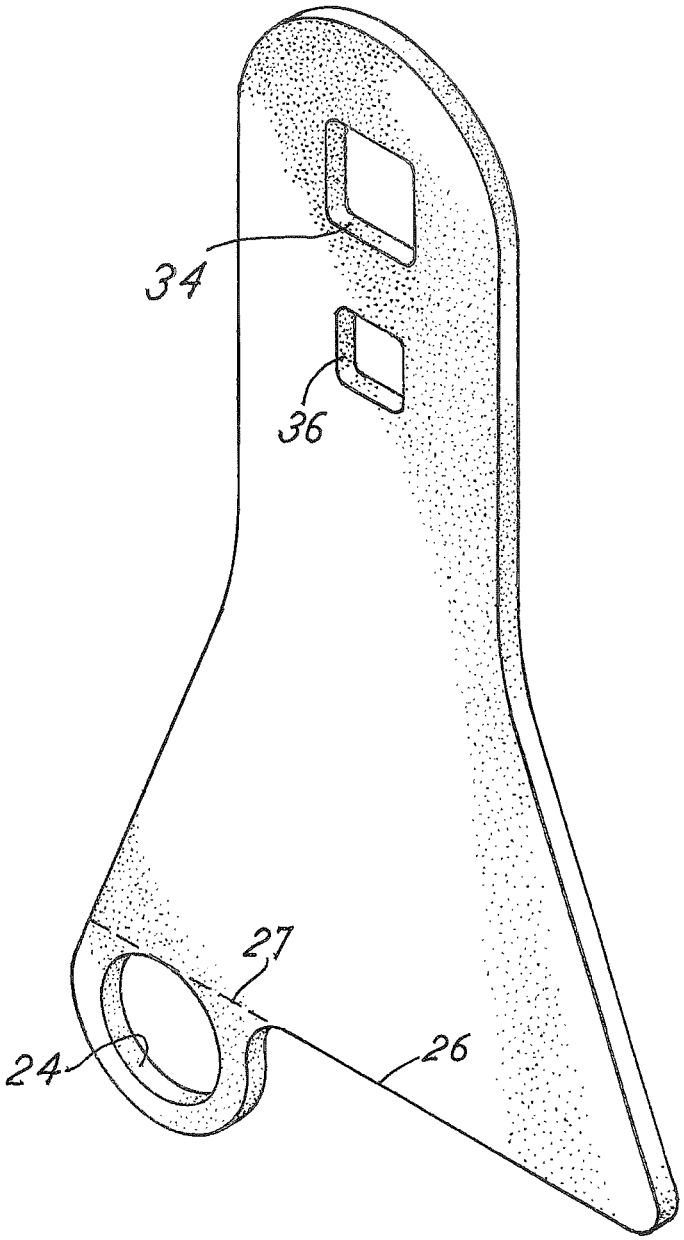
FIG. 2 is a perspective view of the wrench of FIGS. 1.

The tool of the invention comprises a lever of the first kind wherein the lever is designed uniquely to enable utilization in combination with other wrench tools to facilitate the mechanical advantage of a lever arm 20 in combination with a socket and the use of a separate wrench to provide a means for automotive repair procedures of the type described in U.S. Pat. No. 6,343,529 entitled "Fan Clutch Wrench Kit" which is incorporated herein by reference.

Referring to the Figures, the tool or wrench 8 is comprised of a single, flat, uniformly thick, planar plate 10 having a top edge 12, a bottom edge 14, a first lateral side edge 16 and a second lateral side edge 18. The respective edges are joined together to form the perimeter of a tool comprising a lever arm 20 for a lever of the first kind wherein a circular projection 22 with a circular opening or passage 24 therethrough comprises a fulcrum of the lever. The bottom edge 14 further comprises an elongate straight edge section 26 for engagement of the bottom edge 14 with the head of a fastener enabling the tool to function as a wrench. The tool further includes a longitudinal medial axis 30 which comprises, in general, an axis of symmetry of the plate 10 except for the inclusion of the circular projection or section 22. Preferably the top edge 12 is semi-circular and the axial dimension of the tool at a maximum extends along the axis 30 in the range of 5 to 8 inches from the top edge 12 to the bottom edge section 26. The plate 10 further includes a first socket opening 34 and a second socket opening 36. The socket openings 34 and 36 are positioned within the portion of the tool which comprises the lever arm 20. The lever arm 20 extends upwardly from a midpoint 29 of the longitudinal axis 30. Bottom edge 14 of section 26 is normal to the axis 30.

Side wall or edges 17 and 19 of the side wall sections 16 and 18 above midpoint 29 in FIG. 1 are parallel to the axis 30 and equally spaced therefrom rendering the walls 16, 18 symmetrical about the axis 30 in the same manner as are the socket openings 34 and 36. Another important aspect of the invention is the divergence of the side edges 16 and 18 below midpoint 29. The side edges 16, 18 include respectively sections 21, 23 which diverge, uniformly and equally outwardly from midpoint 29 of the longitudinal axis 30. The divergent included angle of sections 21, 23 is about 30° to 90° and an appropriate and preferred range is 45°±5°. However, it is important to note that the divergence affects the relative mechanical advantage of the tool and thus may be customized depending upon the intended use of the tool. Also note that midpoint 29 may be located at various location on axis 30. A preferred location is about midway between top edge 12 and bottom edge 14. Further the axial length of parallel side edges 17, 19 is preferred to be about coincident with the axial distance between top edge 12 and midpoint 29.

The bottom or lower edge 14 is normal to the axis 30 and, importantly, is a straight planner edge 26. The straight planner edge 26 includes a tangent line 27 which is tangent to the upper edge 39 of the circular opening 24. The opening 24 is preferably tangent as depicted in the drawing. The tangent line 27 may be spaced slightly upwardly or downwardly with respect to the circular opening 24 but in the preferred embodiment, the spacing is minimal This ensures the appropriate mechanical advantage is maintained.

Figure 3:
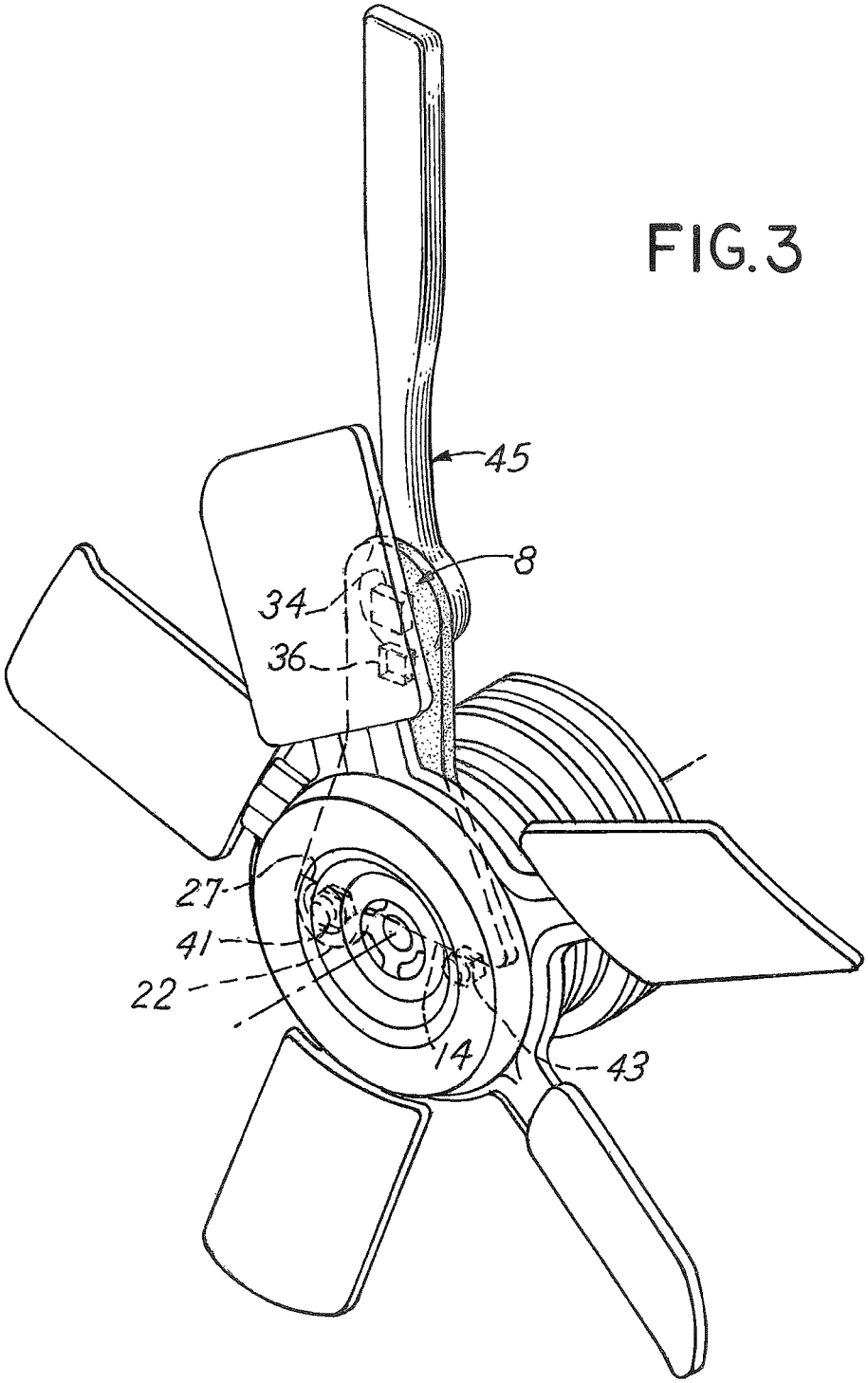
FIG. 3 is an isometric view depicting the position and utilization of the wrench of FIGS. 1 and 2.

In use, the opening 24 which comprises a fulcrum is positioned over a bolt 41 in FIG. 3, or the head of a bolt among a set of two or more bolts wherein the heads of the bolts define a planner configuration or lie in a common or the same plane. Thus, the opening 24 can be fitted over a head of one of the bolts or fasteners. The edge 14 of straight edge section 26 may then be positioned against an adjacent bolt or fastener 43 in FIG. 3, e.g., the head thereof A socket wrench 45 in FIG. 3 may be attached to a lever arm 20 by engaging one of the socket openings 34 or 36. Thereby a lever of the first kind is provided with arm 20, fulcrum opening 24 and edge 14 to provide desired aspects or features. First because the tool is made from a thin metal sheet, it may be fitted into a restricted space. Second because the opening 24 is circular and fitted around a polygonal headed fastener, the tool is assured to remain in place when positioned by a mechanic. Third, because the section 26 of the lower edge 14 is straight and normal to the axis 30, the range of use and the types of use with respect to various needs of mechanics is enhanced. For example, the length of the edge 14 of the straight section 26 enables a wider range of use over a greater spacing of fasteners due to the inherent length of the lever arm formed by edge 14 and thus the feature of a fulcrum which is easily and automatically varied to accommodate the position of the spaced fasteners 41, 43 in FIG. 3. Fourth, straight section 26 avoids a situation wherein a fastener head becomes jammed or locked into position such as would result with a curved bottom edge section. Further by placing the tangent 27 of the straight section 26 generally as described there is an assurance that the tool can effectively and appropriately be placed for the particular task such as the servicing of a fan or a water pump or the like of a vehicle.

The tool of the invention may effectively replace the tool described as holding wrench 21 in U.S. Pat. No. 6,343,529 for engaging bolts 14 and thereby facilitate removal of a fan clutch assembly.

What is claimed is:

1. A universal holding wrench for simultaneously engaging two laterally spaced fasteners in a set of at least three fasteners, said fasteners each having a head in a common plane and radially spaced a substantially equal distance from a common axis normal to said common plane said tool comprising:

a single, flat planar plate of substantially uniform thickness, said plate having a top edge, a bottom edge, first and second spaced lateral side edges connected to and joining the top side edge to the bottom side edge;

a straight, longitudinal axis between the top side edge and the bottom side edge, said bottom side edge including an elongate, straight line edge section normal to the longitudinal axis;

said first and second side edges equally spaced from and parallel to the longitudinal axis between the top side edge and a an intermediate point on the longitudinal axis, said first and second side edges diverging from said point uniformly and equally outwardly from said axis as opposed straight divergent side edges with an included angle in the range of about 30° to 90°, said edges forming a top section generally between said top edge and said point and bottom section generally between said point and said bottom edge;

said bottom section including a partial circular segment connecting the bottom edge to the second side edge, said partial circular segment including a substantially circular opening through the plate, said circular opening located intermediate (a) the second side edge and, the longitudinal axis, and (b) a straight line projection of said straight, bottom edge section tangent to the circular opening, said partial circular segment extending outwardly in a direction away from the top side edge whereby said circular segment comprises a projection extending longitudinally in the direction away from the top side edge, said circular opening sized and characterized to receive a fastener head when said straight bottom edge is simultaneously engaged with an adjacent fastener head to provide in combination a lever of the first kind with said circular opening comprising a fulcrum and;

said top section comprising a lever arm including first and second uniquely shaped socket drive openings through the plate, said socket passage openings symmetrically positioned on said axis, each socket drive opening configured to receive a drive socket.

2. The tool of claim 1 wherein said divergent side edges diverge about 45°±5°.

3. The tool of claim 1 wherein said longitudinal axis dimension between the top side edge and the bottom side straight section edge is in the range of about 5 to 8 inches.

4. The tool of claim 3 wherein said divergent side edge diverge about 45°±5°.

5. The tool of claim 3 wherein the point is substantially a midpoint.

6. The tool of claim 1 wherein the point is substantially a midpoint.

* * * * *